United States Patent [19]

Winegard et al.

[11] Patent Number: 4,568,945

[45] Date of Patent: Feb. 4, 1986

[54] SATELLITE DISH ANTENNA APPARATUS

[75] Inventors: John R. Winegard, Evergreen; Keith B. Cowan, Arvada, both of Colo.

[73] Assignee: Winegard Company, Burlington, Iowa

[21] Appl. No.: 621,069

[22] Filed: Jun. 15, 1984

[51] Int. Cl.[4] ..... H01Q 19/12

[52] U.S. Cl. ..... 343/916

[58] Field of Search ..... 343/840, 912, 913, 914, 343/915, 916

[56] References Cited

U.S. PATENT DOCUMENTS

| | | | |
|---|---|---|---|
| 1,604,899 | 12/1981 | Bannister | 15/20 |
| 2,181,181 | 11/1939 | Gerhard | 343/11 |
| 2,471,828 | 5/1949 | Mautner | 343/18 |
| 2,985,851 | 5/1961 | Lewin et al. | 333/24 |
| 2,997,712 | 8/1961 | Kennedy | 343/916 |
| 3,234,550 | 2/1966 | Thomas | 343/912 |
| 3,247,516 | 4/1966 | Rohn et al. | 343/915 |
| 3,286,270 | 11/1966 | Kelly | 343/915 |
| 3,406,404 | 10/1968 | Maier | 343/915 |
| 3,543,278 | 11/1970 | Payne | 343/915 |
| 3,635,547 | 1/1972 | Rushing et al. | 350/282 |
| 3,725,946 | 4/1973 | Quequen | 343/912 |
| 3,832,717 | 8/1974 | Taggart | 343/840 |
| 3,971,023 | 7/1976 | Taggart | 343/840 |
| 4,169,688 | 10/1979 | Toshio | 404/40 |
| 4,201,991 | 5/1980 | Vines | 343/840 |
| 4,249,184 | 2/1981 | Vines | 343/840 |
| 4,257,207 | 3/1981 | Davis | 52/586 |
| 4,268,835 | 5/1981 | Taggart | 343/915 |
| 4,314,253 | 2/1982 | Sayovitz | 343/765 |
| 4,315,265 | 2/1982 | Palmer | 343/840 |
| 4,378,561 | 3/1983 | Hibbard | 343/912 |
| 4,506,271 | 3/1985 | Gonzalez | 343/915 |
| 4,528,569 | 7/1985 | Felter et al. | 343/916 |

*Primary Examiner*—Eli Lieberman

*Attorney, Agent, or Firm*—Robert C. Dorr

[57] ABSTRACT

A satellite dish antenna having parabolic-shaped support ribs firmly engaging the sides of adjacent screen-mesh reflected petals along the entire longitudinal length of each petal. Each support rib having an upper reflective surface lying in the same plane as the surface of the reflective petal, under which is located a locking arrangement which engages adjacent reflective petals the entire length of the petal.

15 Claims, 17 Drawing Figures

Fig. 9
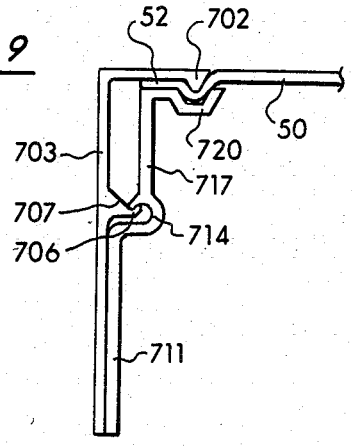
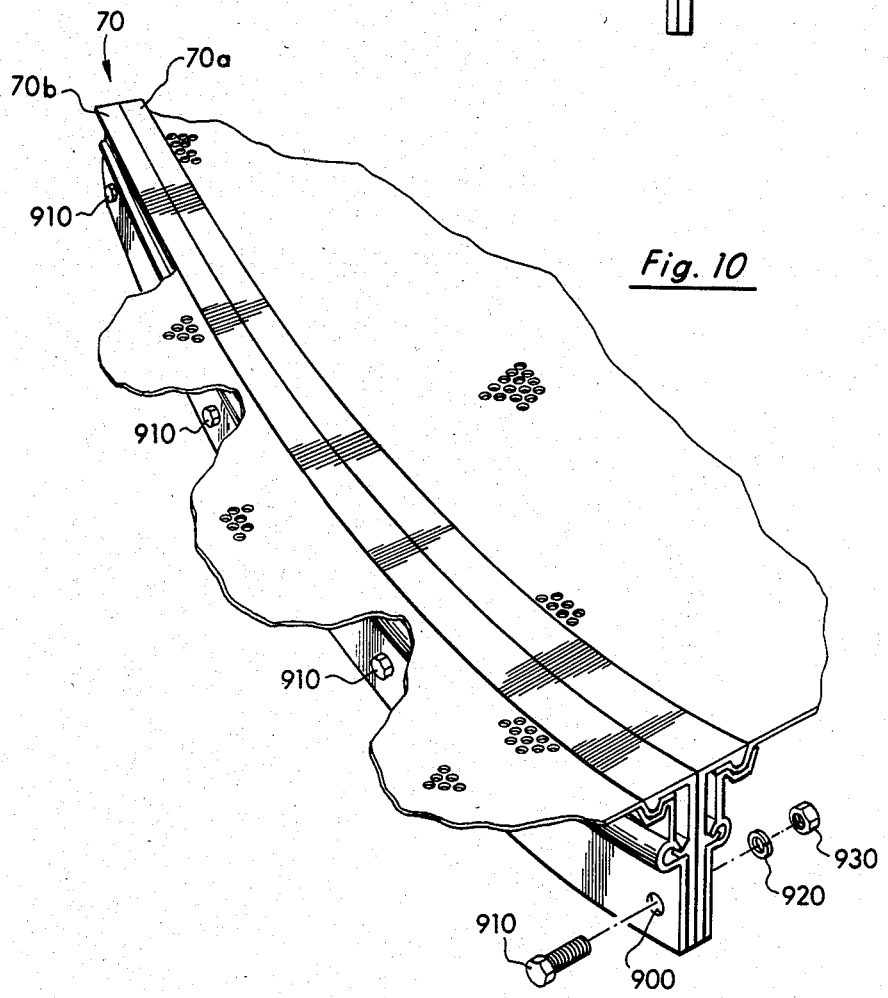
Fig. 10

Fig. 13
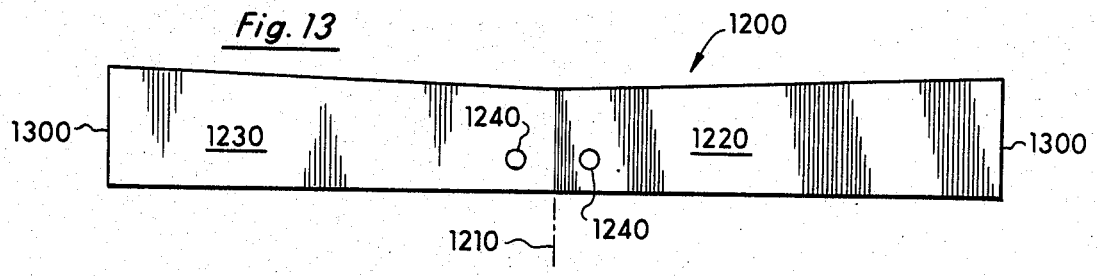
Fig. 14
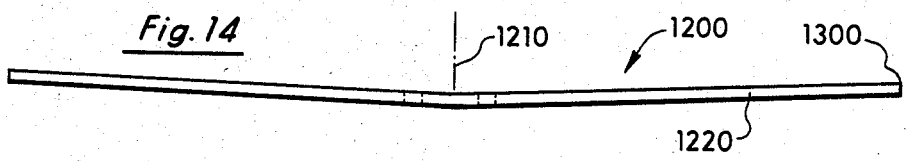
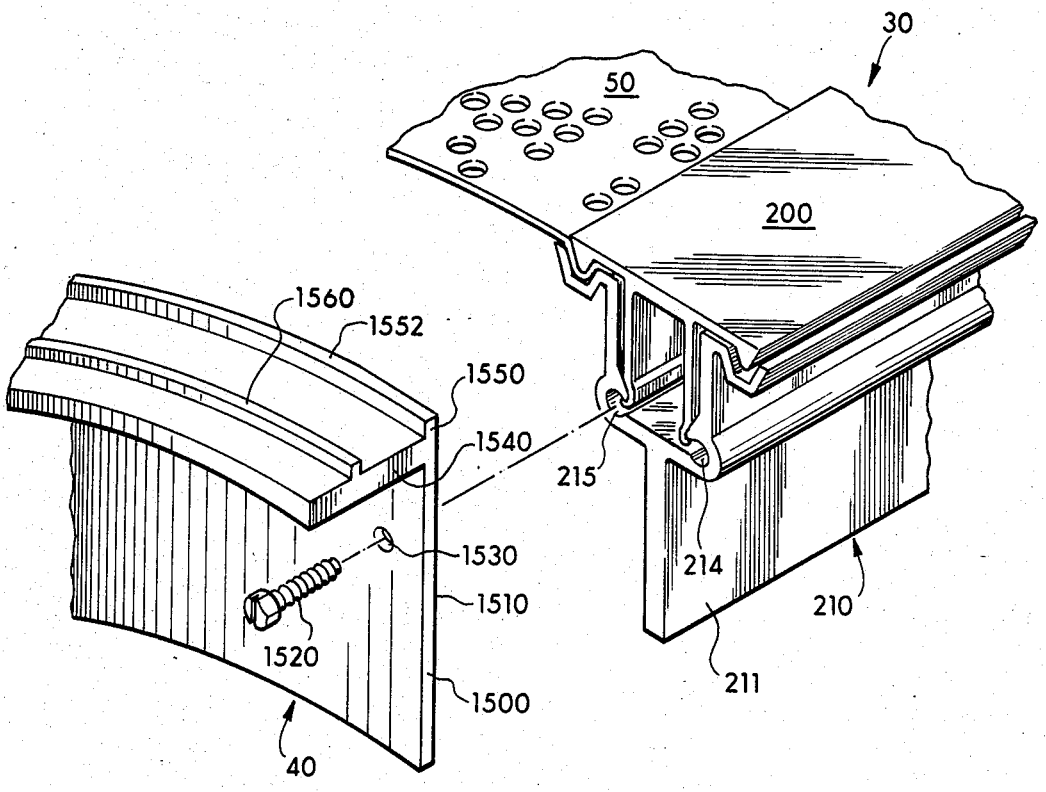
Fig. 15

SATELLITE DISH ANTENNA APPARATUS

BACKGROUND OF THE INVENTION

1. Related Applications

This application is related to:

a. Satellite Dish Antenna Support Split Rim—Ser. No. 569,836—Filing Date Jan. 11, 1984, b. Satellite Dish Antenna Support Rim—Ser. No. 569,831—Filing Date Jan. 11, 1984, and c. Satellite Dish Antenna Outer Rim—Ser. No. 566,816—Filing Date Dec. 29, 1983.

2. Field of the Invention

This invention relates to the design and construction of a satellite dish antenna. More particularly, it relates to a satellite dish antenna having modular segments for easy manufacture and installation.

3. Discussion of the Prior Art

Over the past decade, the use of satellite dish antennas by the consuming public has increased substantially. Two general categories of dish antennas have been involved. The first category contains those dish antennas made of solid material, such as fiberglass, which is molded into a parabolic shape. These antennas generally have the high gain and signal reception, but are expensive to ship and have a high wind load when installed. The second category of dish antennas relates to those antennas having a screen-mesh material for the reflective surface. Such antennas are assembled in sections and, therefore, are less expensive to ship. They also exhibit low wind load characteristics but have overall gain and signal reception. The reason for the lower gain in such screen-mesh antennas is, in primary part, due to their approximation of the true parabolic shape such as through use of a number of linearally shaped segments.

Prior to making an application for the present invention, a patentability search was performed. The results of this search are as follows:

| Inventor | U.S. Pat. No. | Issue Date |
|---|---|---|
| E. Gernard | 2,181,181 | Nov. 28, 1939 |
| S.E. Mautner | 2,471,828 | May 31, 1949 |
| L. Lewin et al. | 2,985,851 | May 23, 1961 |
| D.S. Kennedy | 2,997,712 | Aug. 22, 1961 |
| R.E. Thomas | 3,234,550 | Feb. 8, 1966 |
| E. Kelly | 3,286,270 | Nov. 15, 1966 |
| A.C. Maier | 3,406,404 | Oct. 15, 1968 |
| H.A. Payne | 3,543,278 | Nov. 24, 1970 |
| Rushing et al. | 3,635,547 | Jan. 18, 1972 |
| Queguen | 3,725,946 | Apr. 3, 1973 |
| Taggart, Jr. | 3,832,717 | Aug. 27, 1974 |
| Taggart | 3,971,023 | July 20, 1976 |
| Toshio | 4,169,688 | Oct. 2, 1979 |
| Vines | 4,201,991 | May 6, 1980 |
| Vines | 4,249,184 | Feb. 3, 1981 |
| Davis | 4,257,207 | Mar. 24, 1981 |
| Taggart | 4,268,835 | May 19, 1981 |
| Bannister | 1,604,899 | Dec., 1981 |
| Sayovitz | 4,314,253 | Feb. 2, 1982 |
| Palmer et al. | 4,315,265 | Feb. 9, 1982 |
| Hibbard et al. | 4,378,561 | Mar. 29, 1983 |

The 1983 patent to Hibbard (U.S. Pat. No. 4,378,561) relates to a parabolic reflector antenna formed by assembling identical pie-shaped sections of parabolically curved plastic. The sections are preferably glued together along the joints provided along the radial edges.

The patents issued to Taggart (U.S. Pat. Nos. 3,832,717; 3,971,023; and 4,268,835) all relate to parabolic reflectors comprised of generally triangular shaped pedals joined together in an edgewise overlapping relationship. In the '023 and '717 patents, an outer rim is provided around the dish antenna to provide outer support. In the '835 patent, a tubular outer segmented rigid rim is provided wherein the opposing ends slideably engage with the next segment. The edgewise overlapping pedals are bolted together by means of a plurality of holes.

The 1970 patent issued to Payne (U.S. Pat. No. 3,543,278) also relates to a sectional parabolic reflector wherein individual pedal sections are held together by a support molding 17 as shown in FIG. 3 which in turn is bolted to the edges of each section.

The two patents issued to Vines (U.S. Pat. No. 4,201,991 and 4,249,184) relate to a parabolic antenna kit comprised of a number of pre-stressed support arms (made from wood) which supports a plurality of screen reflector segments. A tensioning cable engages the outer ends of each support arm and provides sufficient tension, upon assembly, to stress the support arms into a parabolic shape. The parabolic screen is connected to the wood support arms by means of staples or twisted wires.

The patents issued to Sayovitz (U.S. Pat. No. 4,314,253), to Kelly (U.S. Pat. No. 3,286,270), to Maier (U.S. Pat. No. 3,406,404), and to Palmer (U.S. Pat. No. 4,315,265) all relate to collapsible dish antennas of various shapes and configurations. The antennas are assembled as a whole and can be shipped in a collapsed position and at the site can be selectively moved into the operative position.

The remaining patents uncovered in the search are of interest but are not as pertinent to the present invention as are the above patents.

From an analysis of these prior art patents, it is clear that a parabolic dish antenna exhibiting the greatest gain with the lowest cost to the consuming public would be one that incorporates the following features: one that exhibits low wind load characteristics, one that is segmented for ease in shipping, one that is designed to be easily manufactured, and one that can be assembled at the site with a minimum of labor.

Typical of commercially available satellite dish antennas exhibiting low wind load being advertised at the date of this application are the following which antennas may or may not serve as prior art references to this invention.

ECI—This is an eleven foot antenna made from all stainless steel hardware which utilizes eight interchangeable corrosion-free reflector panels each panel having a reflective screen. Each reflective panel contains four segments wherein each segment has a linear outer rim. This antenna has an advertised 42.0 DB gain and advertises that it can be assembled in less than one hour. It is manufactured by BR Satellite Communication, 216-11 Kingsbury Avenue, Bayside, N.Y. 11364.

PARACLIPSE—The paraclipse antenna utilizes a welded aluminum rib and ring truss system having concentric ring trusses to which heavy expanded aluminum mesh is fastened. The paraclipse antenna has eight triangular segments with linear outer edges with two internal concentric ring trusses provided for support. PARACLIPSE is manufactured by Paradigm Manufacturing Inc., 6911 E. Side Road, Redding, Calif. 96001.

AN-1200—This is a twelve foot antenna utilizing micro-grid "see through" expanded aluminum reflecting surfaces. The grid antenna has an advertised 42.3

DB alleged gain. The antenna has sixteen segments supported by rib trusses and four concentric ring trusses. The fifth outer ring truss is curved. Model AN-1200 is manufactured by Conifer Corporation, 1400 North Roosevelt, Burlington, Iowa 52601.

XL10A—This is a three meter screen antenna having a number of parabolically shaped rib trusses and an outer rim formed of linear elements between each rib truss. It is manufactured by Microsat, Route 47, Washington Depot, Conn. 06794.

TRIANGLE—This is a twelve foot mesh antenna with an advertised 76.99% efficiency rating. It utilizes a rib and concentric ring truss system having 24 rib trusses and three concentric ring trusses. The outer ring is linear between each rib and it is made by Triangle Engineering Company, P.O. Drawer 38271, Houston, Tex. 77238.

LINDSAY—Lindsay has eight and ten foot screen dishes constructed from a rib design having eighteen rib trusses broken down into six segments each containing three rib sections. The concentric rim around the antenna is curved. Lindsay Specialty Products Ltd., 50 Mary Street, West Lindsay, Ontario, Canada K9B 4F7.

STARDISH II—This is an aluminum mesh satellite dish antenna having a pattern of concentric ring trusses and rib trusses and is made by Pilant Systems, 3532 Giande Blvd., Sacramento, Calif. 95832.

The ultimate goal is designing a screen-mesh satellite dish antenna is to provide a reflecting surface that is as near the shape of a true parabola as is possible. The present invention unlike the above screen-section approaches has each screen mesh section and each support rib stretch-formed into a parabolic shape. The present invention further eliminates the need for hundreds of bolts, washers, screws, or other fasteners which causes distortion to the reflecting surface and, therefore, lowers the overall efficiency of the antenna. Under the teachings of the present invention and unlike that set forth above, a unique rib-locking system is provided which holds each screen-mesh segment at a point below the upper reflecting surface of each support rib. Hence, the upper reflecting surface of each rib and the upper surface of each screen-mesh petal are all held in the same parabolic reflecting plane without causing distortion to the reflected signal. Because the ends of each screen-mesh petal are locked along the entire length of the support ribs, no stress is provided to the petals and each petal maintains its parabolic shape even in severe environmental conditions such as wind, ice, and snow. Finally, because of the simplicity of the design, the dish antenna of the present invention can be easily and rapidly assembled at a site.

SUMMARY OF INVENTION

The satellite dish antenna of the present invention involves at least two sections which can be stacked for shipment and transportation. Each section includes a number of screen-mesh panels substantially parabolic in shape, a parabolic-shaped support rib firmly engaging the sides of adjacent screen-mesh petals for holding the sides directly to each support rib along the entire longitudinal length of each petal, a parabolic curved split support rib firmly engaging the sides of the screen-mesh petals located on the sides of each section also for holding the sides near the center of each split support rib. The two sections are bolted together to form the satellite dish antenna.

Each support rib has an upper reflective surface which lies in the same plane as the surface of the screen-mesh and under the upper reflective surface is located a locking arrangement which engages the ends of each adjacent screen-mesh petal the entire length of the petal to firmly hold the petal.

DESCRIPTION OF THE DRAWING

FIG. 9 is a side planar view of the split rib member of the present invention firmly holding the screen-mesh;

FIG. 10 is a partial perspective illustration showing the assembly of the two halves of the split rib member 70 of the present invention;

FIG. 13 is a side planar view of the splicing bar of the present invention;

FIG. 14 is a top planar view of the splicing bar of the present invention;

FIG. 15 is a partial perspective, exploded view of the engagement of the inner ring to the ends of the rib members of the present invention;

BEST MODE FOR CARRYING OUT THE INVENTION

1. General Discussion

Figure 1:
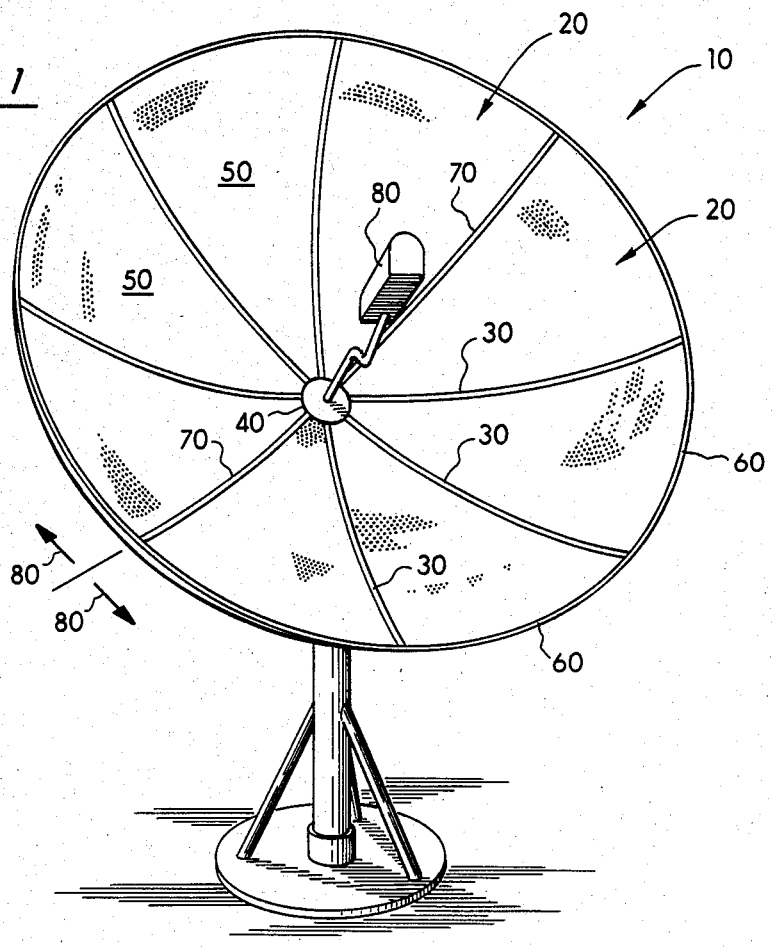
FIG. 1 sets forth a perspective view of the satellite dish antenna of the present invention.

In FIG. 1, the dish antenna 10 of the present invention is set forth installed at a particular location. The dish antenna 10 of the present invention includes a number of segments or petals 20, a number of support ribs 30, an inner support ring 40, and an outer support rim 60. A preformed screen-mesh 50 is provided in each petal 20 between adjacent support ribs 30.

As will be discussed in the following, the satellite dish antenna of the present invention is split into at least two sections 80 about a split support rib 70. In the embodiment shown in FIG. 1, each section 80 contains four petals 20, three support ribs 30, two split ribs 70 and four outer rim portions 60.

In shipping and transportation, the two sections 80 are separated along the split ribs 70 and are stacked on top of each other for shipping. While the preferred invention uses two sections 80, it is to be understood that more than two sections could be created. For example, four sections 80 could be provided with each section having two petals 20. In that embodiment, split support rib 70 would be disposed between two adjacent support ribs 30. Furthermore, while the preferred invention contemplates the use of eight petals 20 it is to be expressly understood that more or less petals could be used.

2. Physical Construction of the Present Invention

Figure 2:
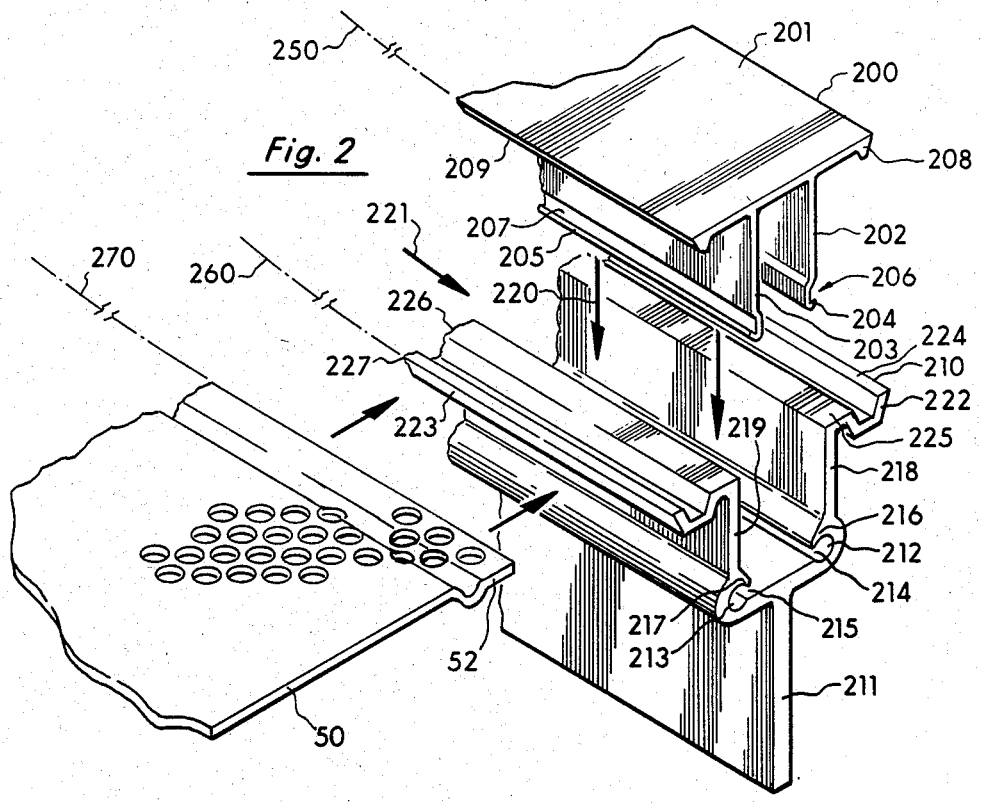
FIG. 2 sets forth, in partial perspective exploded view, the insertion of the upper rib member into the lower rib member to lock onto one end of the reflective screen-mesh.
Figure 3:
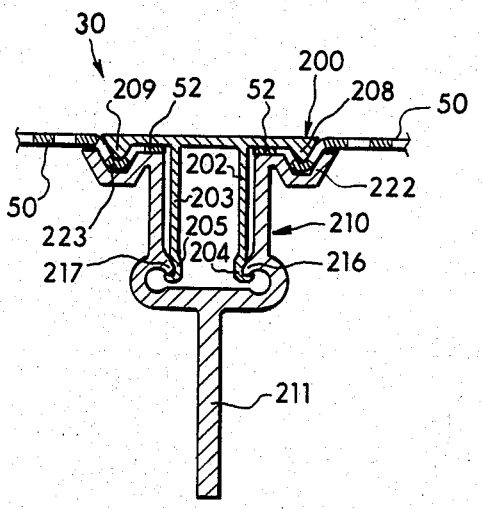
FIG. 3 sets forth, in side cross-sectional view, the engagement of the screen-mesh by the support rib of FIG. 2.

A. Support Rib 30—In FIGS. 2 and 3 are shown the details of the support rib 30. The support rib 30 comprises an upper locking rib member 200 and a lower locking rib member 210. Both locking members 200 and 210 are made from elongated extruded aluminum pieces and are stretch formed to follow a parabolic curve 250 and 260. The length of each member 200 and 210 is dependent upon the size of the dish antenna 10 of the present invention. In the preferred embodiments, the dish antenna can be 6 feet, 8 feet, or 10 feet in diameter.

The upper member 200 is inserted into the lower member 210 by pushing member 200 in the direction of arrow 220. As will be explained in the following, the end 52 of the screen-mesh portion 50 is firmly held between members 200 and 210.

The upper rib member 200 includes a flat upper surface 201 having two downwardly extending prongs 202 and 203. Each prong 202 and 203 downwardly extends and terminates in a hook 204 and 205 respectively. Each hook 204 and 205 has an outwardly and upwardly directed formed channel 206 and 207 respectively. Downwardly extending prongs 202 and 203 are substantially parallel to each other and the ends 204 and 205 are capable of slightly flexing inwardly towards each other. On the underside of surface 201 are two downwardly extending ridges 208 and 209. As shown in FIGS. 2 and 3, each ridge 208 and 209 is substantially triangular in cross-section.

The lower rib member 210 which is the other half of rib 30 has a downwardly extending vertical plate 211 extending the full longitudinal length of the lower support rib 210. This vertical plate 211 provides structural strength for rib 30. At the upper end of vertical plate 211 are two formed circular cavities 212 and 213 also extending the longitudinal length of the lower support rib 210. The circular cavities 212 and 213 have an opening 214 and 215 which face each other. Lips 216 and 217, downwardly extending, terminate at the upper end of the openings 214 and 215. The lips 216 and 217 extend the longitudinal length of the lower rib member 210. Extending upwardly from each locking lip 216 and 217 are a pair of vertical parallel plates 218 and 219. Parallel plates 218 and 219 form a channel 221 which is receptive of the downwardly extending prongs 202 and 203 of the upper rib member 200. Each plate 218 and 219 terminates at its upper end into outwardly extending horizontal formed channels 222 and 223. Each channel 222 and 223 essentially forms a trapezoidal opening with the upper side of the trapezoid open, the two opposing sides inwardly slant to a bottom side having a shorter length than the upper open side of the trapezoidal shape. In the configuration shown, the upper surfaces 224, 225, 226, and 227 are flat and are oriented in the same horizontal plane which plane follows the longitudinal parabolic curve of 260.

The ends 52 of adjacent screen-meshes 50, as shown in FIG. 3, are inserted between the ridges 208 and 209 and the channels 222 and 223. The length of the prongs 202 and 203 are designed such that when channels 206 and 207 engage lips 216 and 217, the upper member 200 firmly abuts against end 52 of screen-mesh 50 to hold it firmly in channels 222 and 223 of lower rib member 210. It is to be noted that the lips 216 and 217 engage the channels 206 and 207 the entire length of the rib members 200 and 210 and, therefore, the ridge 208 and 209 firmly hold the wire mesh screen 50 along the entire length of its edge 52 in the corresponding channels 222 and 223.

The upper rib member 200 snaps into the lower rib member 210 due to the inward flexing action of ribs 202 and 203 as it is pushed downwardly in the direction of arrow 220.

Figure 4:
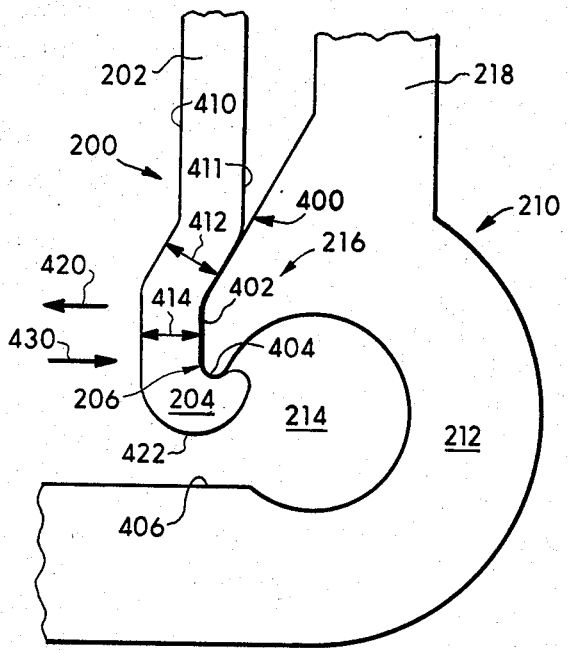
FIG. 4 sets forth the details, in planar view, of the locking mechanism for holding the upper rib member of FIG. 2 firmly to the lower rib member.

The details of the locking arrangement between the upper member 200 and the lower member 210 is shown in FIG. 4. The lower member 210, as mentioned, has a lip 216 which engages a hook 204 having a formed locking channel 206 of the upper rib member 200. The lip 216 is an extension of a downward incline or ramp 400 depending from plate 218. Ramp 400 terminates in a vertical edge 402 which terminates in an arcuate tip 404. The arcuate tip 404 then joins a circular portion 212 which forms the open circular cavity 214. Circular portion 212 terminates in a horizontal or flat edge 406 which extends over to circular cavity 215 as shown in FIG. 2.

The locking channel 206 located in the hook 204 of prong 202 of the upper member 200 is designed as follows. The prong 202 which is vertical, and comprised of two parallel sides 410 and 411 undergoes a slight bend or offset 412 into a second vertical portion 414. At the end of vertical portion 414, is located the hook 204. Hook 204 is upwardly oriented to positively engage with the arcuate tip 404 and vertical edge 402. As can be witnessed, in FIG. 4, the locking channel 206 is sufficiently deep to positively engage the arcuate tip 404 in a locking fashion the entire length of rib 30.

When the upper rib member 200 is pushed downwardly in the direction of arrow 220 of FIG. 2, the prong 202 is bent inwardly in the direction of arrow 420. When the bottom edge 422 of hook 204 abuts the inclined surface or ramp 400, the prong moves in the direction of arrow 420. As the upper rib member 200 is continually pushed in the direction of arrow 220, the hook 204 passes below the tip 404 and suddenly snaps the tip 404 into the channel 206 thereby locking the upper rib member 200 to the lower rib member 210 firmly in place. When locked into position, the prong 202 engages the locking lip 216 with a force in the direction of arrow 430.

Figure 5:
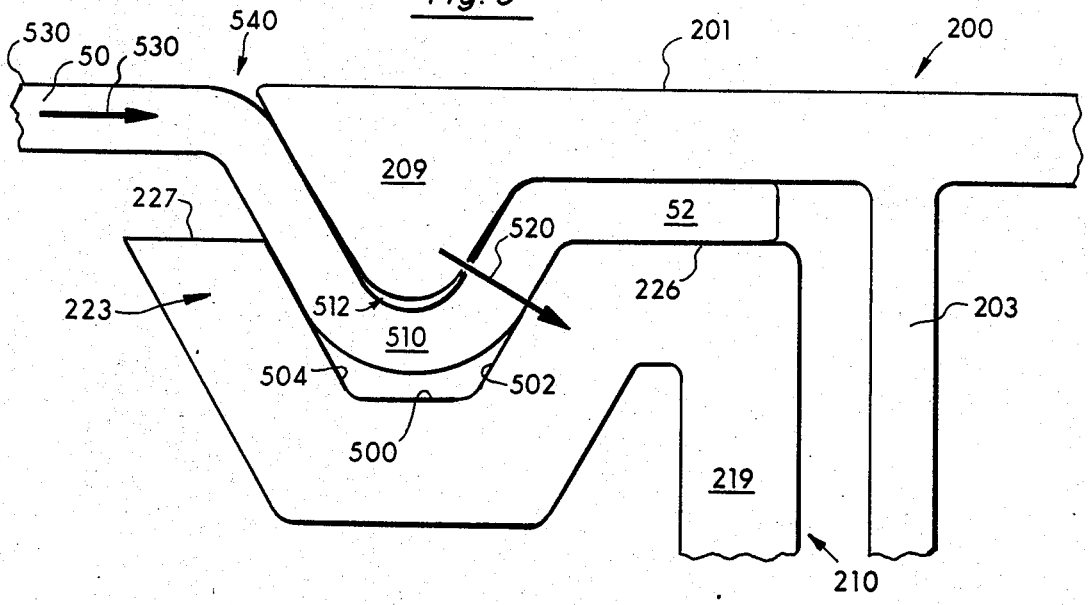
FIG. 5 sets forth, in side planar view, the engagement of the upper rib member holding the end of the reflective screen-mesh firmly to the lower rib member.

The details of the construction of the engagement of the screen-mesh 50 with the lower member 210 and the upper member 200 is set forth in FIG. 5. As mentioned, the vertical plate 219 of the lower rib member 210 terminates in an outwardly extending channel 223. That channel is comprised of three sides of a trapezoid and, in particular, comprises a bottom end 500 and outwardly and upwardly inclined sides 502 and 504. Sides 500, 502, and 504 are substantially linear. The fourth side of the trapezoid is open to form the channel 223. Channel 223 is designed to hold end 52 of the screen-mesh 50. As shown in FIG. 5, end 52 undergoes a downward arcuate bend 510 having an upward arcuate opening 512. The upper arcuate opening 512 receives the downward extending ridge 209 of the upper member 200. When the upper member 200 is in the locked position as shown in FIG. 4, the ridge 209 firmly engages the entire longitudinal length of the formed arcuate channel 512. While ridge 209 holds the side of the screen-mesh, it does not apply tension or force in the direction of arrow 530. Hence, the firm engagement provided by ridge 209 and channel 223 does not affect the stretch formed parabolic shape of each petal. However, in the case of a wind load impacting on the antenna of the present invention, a force is exerted in the direction of arrow 520 through end 52 against linear edge 502 of the end 52. The application of force 520 causes a corresponding force 530 to be exerted in the direction of arrow 530 on the screen-mesh 50. These forces 530 are inwardly directly towards the center of the rib. The application of force 530 causes the screen-mesh 50 to windstand high wind loads.

Figure 6:
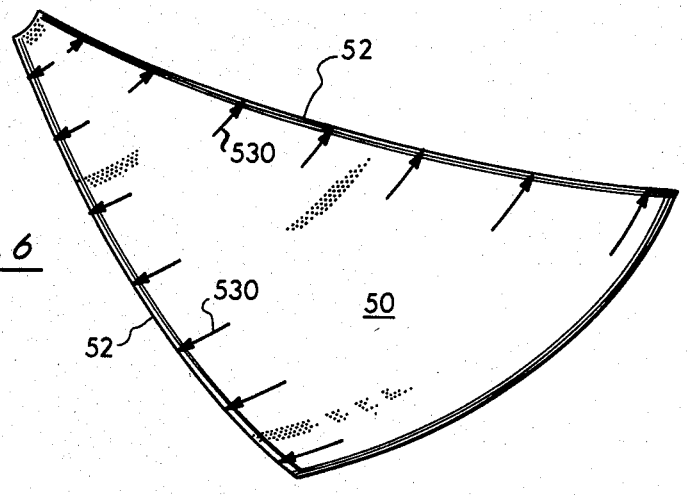
FIG. 6 is an illustration setting forth the continuous application of forces along opposing ends of the screen-mesh under a windload.

The ability to withstand wind load or other loads is best shown by reference to FIG. 6 which shows, in illustration, the continuous application of the forces 530 along the opposing ends 52 of the screen-mesh petal 50. These forces 530 are inwardly directed towards the center of the rib. Heavy wind loads, or the loads from other environmental considerations such as ice or snow, have an adverse effect on discrete or point connection points which connect the screeh-mesh to the support ribs found in some prior art references. The accumulative effects of wind and other environmental stresses between the screen-mesh and the support ribs cause permanent relaxation to occur around these discrete connection points thereby causing the screen-mesh to have humps, bumps, or other perturbations occurring along its surface. These stress-caused changes to the parabolic surface of conventional dish antennas are substantially eliminated in the present invention by providing a continuous connection line along the parabolic curved ends 52. The continuous coupling of the present invention provides a stable parabolic configuration even in the presence of such environmental stresses. It is to be expressly understood, however, that if extreme hail or the throwing of objects such as large rocks at the dish antenna 10 of the present invention, of course, will cause undesired permanent stressing to occur. It is the goal of the present invention to substantially eliminate stressing due to normal environmental conditions such as high winds, snow loads, and the like by providing continuous connecting lines as opposed to discrete contact points.

Each screen-mesh petal 50 is stretch formed over a form such as a shaped wooden block in the shape of a substantial paraboloid having two opposing curved parabolic shaped longitudinal sides and two opposing curved circular shaped ends. As previously discussed, each of the sides has a formed downwardly directed arcuate bend extending the entire length of each side.

In addition, and with reference to FIG. 5, it is to be noted that surface 201 of the upper member 200 and surface 530 which is the upper surface of the screen-mesh 50 are disposed in the same circular plane at any given cross-section. Again, this feature insures that undistorted reflection of the incoming electromagnetic signal occurs into the receiver 80. It is important to minimize reflections from surfaces at different levels to maximize gain and to minimize distortion. Hence, the surface of the rib 201 reflects signals from the same plane as the surface 530 of the screen-mesh 50. This type of reflection is continuous along the entire longitudinal length of each rib 30 and, as will be explained, also along the longitudinal length of each split rib 70. The only possible distortions would arise from reflections in the area 540 between the screen-mesh 50 and the upper member 200. However, no reflections are generated by the connecting means 204 and 216 which, as shown in FIG. 3, is located under reflecting surface 201 which is shown in FIG. 4. This is to be distinguished with conventional approaches such as, for example, a twisted wire used to connect the wire mesh screen to the support ribs such as those used in the Vines' patents. Hence, reflections from these types of conventional connectors are fully eliminated. In addition, while the present invention is particularly adopted to screen-mesh petals, it is to be expressly understood that solid stretch-formed reflective panels could be utilized.

B. Split Support Rib 70—In FIGS. 7, 8, and 9 the details of the split rib 70 are set forth to include an upper member 700 and a lower split rib 710. The upper split rib 700 engages the end 52 of the screen-mesh 50 in a fashion similar to that priorly discussed for rib 30. The upper member 700 contains an upper surface 701 having a triangular shape elongated ridge 702 extending downwardly at one end. The surface 701 is cantilevered from a vertical plate 703 which has a flat vertical surface 704 disposed on one side and a flat vertical surface 705 disposed on the other side with an outwardly extending locking lip 706. The locking lip 706 is an elongated lip disposed on an inclined ramp 707 and is substantially perpendicular thereto.

The lower split rib member 710 also has a vertical plate 711 having opposing flat vertical sides 712 and 713. The upper end of plate 711 terminates in a formed substantially circular channel 714 having one end open towards the surface 712. The upper end of channel 714 has a downwardly extending ramp surface 715 terminating in the upper portion 716 of channel 714. The ramp 715 terminates in a vertical elongated plate 717 which, in turn, terminates in a rearwardly extending horizontal channel 720. Channel 720 has a defined trapezoidal shaped trough 722 with flat horizontal surfaces 724 and 726 disposed in the same plane.

Both the upper member 700 and the lower member 710 are elongated in shape and follow the parabolic curve 250 and 260 respectively.

Figure 8:
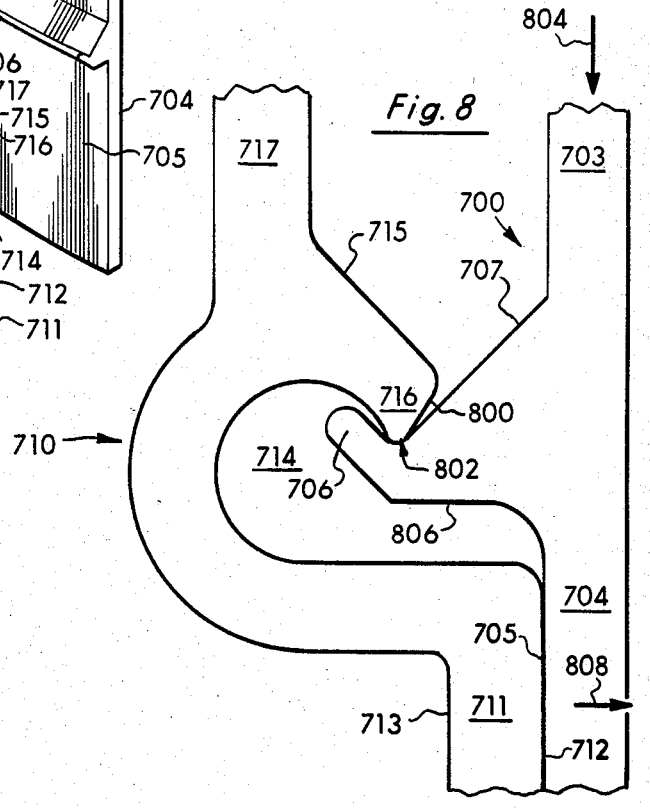
FIG. 8 is an enlargement of the locking mechanism for the split rib member of FIG. 7.

The details of the locking arrangement of the split rib 70 are shown in FIG. 8. As can be observed, the locking ridge 716 firmly engages the valley 802 formed between outwardly extending lip 706 and the inclined ramp 707. The lip 716 has a first substantially flat surface 800 which is at a greater angle than the angle of the ramp 707. This angular relationship helps to positively seat the lip 716 into the valley 802. In the locking arrangement shown, an alignment and continuous force is exerted by the lip 716 into the valley 802 along the entire parabolic longitudinal length of both members 700 and 710. This force exerts a downward pressure in the direction of arrow 804 on the upper member 700.

Because the upper member 700 and lower member 710 are essentially identical in construction to that shown in FIG. 5, it is to be expressly understood that the force shown by arrow 804 results in a comparable force shown as arrow 520 in FIG. 5 in the presence of an environmental load to properly hold the screen-mesh 50.

In installation, the lower edge 806 of the lip 706 travels along surface 715 as the upper split rib member 700 is moved downwardly in the direction of arrow 804. During this downward movement, the upper member swings outwardly in the direction of arrow 808 until portion 716 engages surface 800 and then it moves in the opposite direction of arrow 808 to quickly snap in place locking portion 716 into the valley 802.

Figure 7:
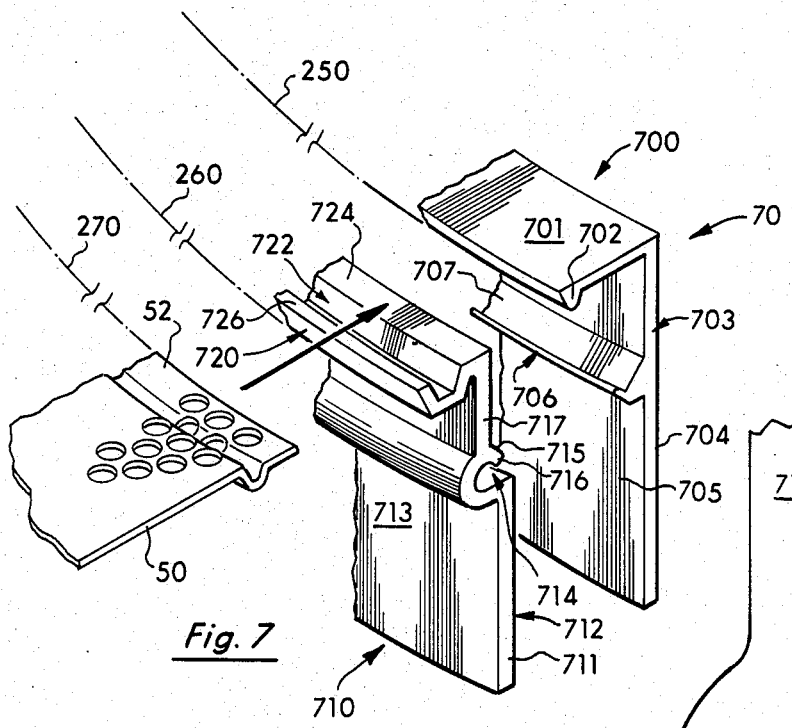
FIG. 7 is a partial perspective exploded view of the split rib member of the present invention.

In the configuration of FIG. 8, the vertical surfaces 705 and 712 are flat and abut each other in parallel relationship. As shown in FIG. 7, when the upper member 700 is locked into the lower member 710, the two members 700 and 710 are held firmly together.

The construction of the split rib shown in FIGS. 7 through 9, represents one-half of the overall split rib member 70 as shown in FIG. 10. Two split rib portions 70(*a*) and 70(*b*) have a plurality of formed holes 900 at predetermined spaced intervals, four in the preferred embodiment. The holes 900 from each half section 70(*a*) and 70(*b*) align and bolts 910 can be inserted through the holes to engage a lock washer 920 and a nut 930 to firmly hold the two half sections 70(*a*) and 70(*b*) together. As shown in FIG. 1, the dish antenna of the present invention is split into two sections 80 and, hence, as shown in FIG. 9, these two half sections can be quickly bolted together or unbolted for transportation.

Figure 11:
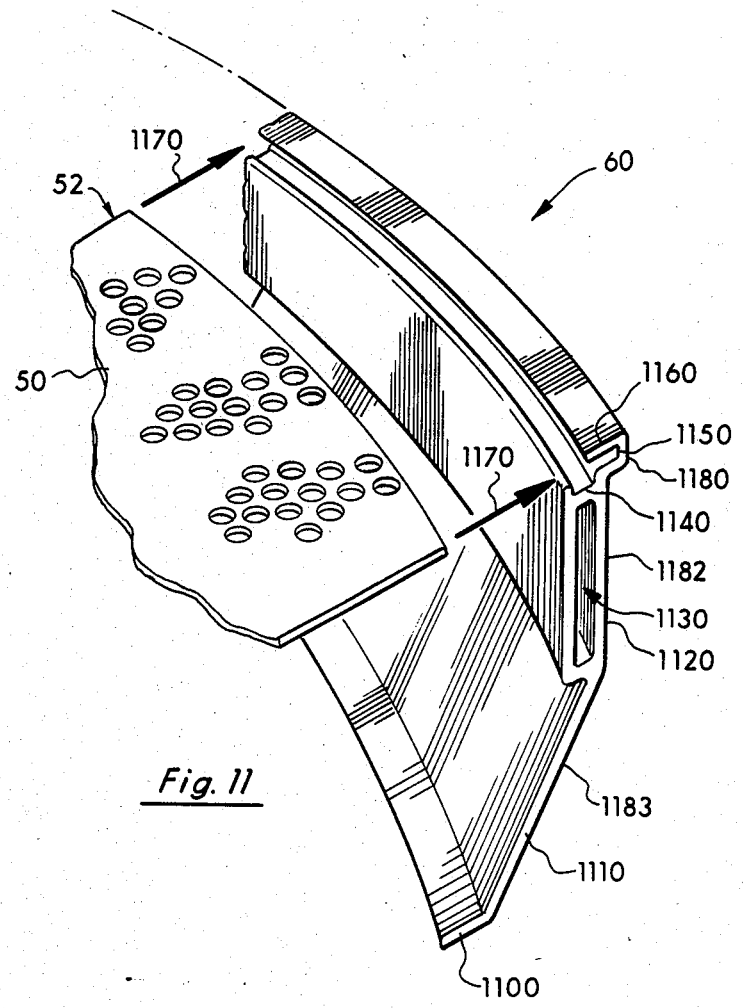
FIG. 11 is a partial perspective exploded view of the outer rib member of the present invention in relation to the outer edge of the screen-mesh.
Figure 17:
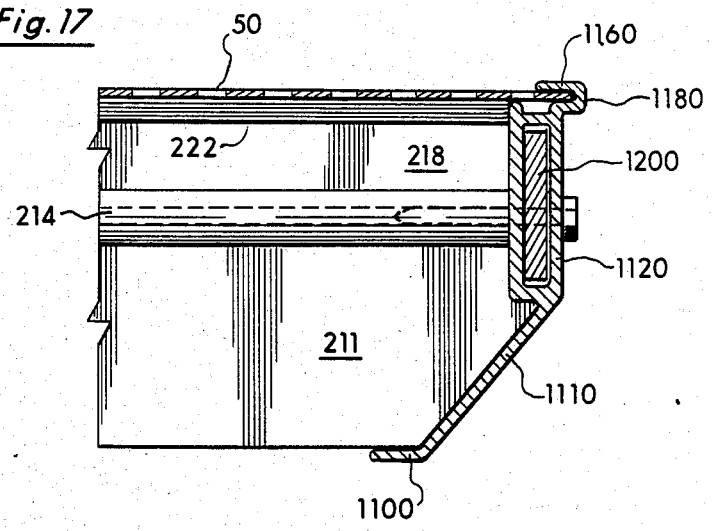
FIG. 17 is a side cross-sectional view showing the attachment of the rib support member to the outer rim of the present invention.

C. Outer Rim 60—The design of the outer rim 60 is set forth in FIG. 11. The outer rim 60 includes a lower substantially horizontal plate 1100 which functions to provide structural support to the outer rim and to engage the ends of the support ribs 30 and 70 as shown in FIG. 17. Plate 1100 terminates in an inclined and upwardly directed plate 1100 which terminates in a hollow rectangularly shaped portion 1120 which includes a rectangular hollow cavity 1130. At the top of the rectangular portion 1120 is a formed channel 1140 which terminates in a formed rearwardly directed cavity 1150. Over the rearwardly directly cavity 1150 is a flat surface 1160. The outer rim segment 60 receives end 52 of the screen-mesh 50. When the antenna of the present invention is assembled, the end 52 is received by cavity 1150. In other words, the screen-mesh is moved in the direction of arrow 1170 into the cavity 1150.

The surfacs 1180, 1182, and 1183 on the outer periphery of rim 60 are designed for esthetic purposes. Of course, these surfaces can be any shape or configuration including circular, curved, humps, etc.

Figure 12:
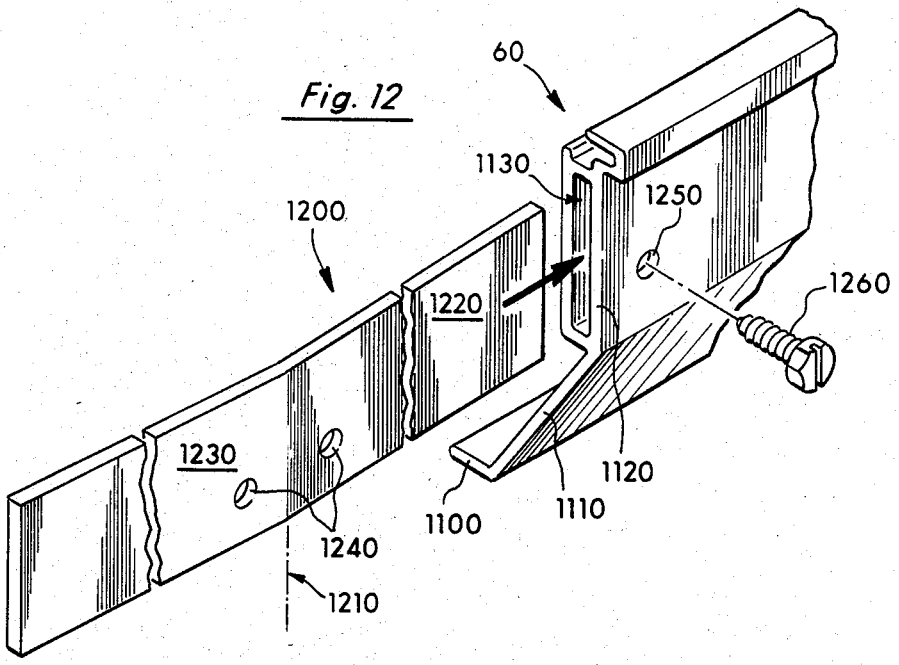
FIG. 12 is a partial perspective exploded view of the outer rim of the present invention in relation to the splicing bar.

The outer rims 60 are interconnected together in the fashion set forth in FIGS. 12 through 14. A bow-tie shaped splice bar 1200 is utilized. The splice bar 1200 is symmetrical about line 1210 and contains two extending portions 1220 and 1230. As shown in FIG. 12, portion 1220 slideably engages cavity 1130 of the outer rim 60. When it is fully inserted into cavity 1130, so that line 1210 aligns itself with the end of the cavity 1130, hole 1240 aligns with hole 1250 and a screw 1260 slideably engages the formed hole 1250 to engage cavity 214 as shown in FIG. 17. Portion 1230, likewise, slides into the adjacent cavity 1130 so that the ends of each cavity 1130 abut each other along line 1210 when the splice bar 1200 is fully inserted. As shown in FIG. 13, end 1300 of splice bar 1200 is larger than the length of the splice bar at line 1210. Likewise, as shown in FIG. 14, the splice bar 1200 is slightly angled about line 1210 and, in the preferable embodiment, this is approximately two degrees.

D. Inner ring 40—FIG. 15 shows the assembly of the inner support ring or rim 40 to rib member 30. The inner support ring 40 contains a wall portion 1500 having a flat surface 1510 to which one end of the rib 30 engages. Two screws 1520 enter a formed hole 1530 in wall 1500 and threadedly engage the formed cavities 214 and 215 to firmly hold the rib member 30 against surface 1510.

Figure 16:
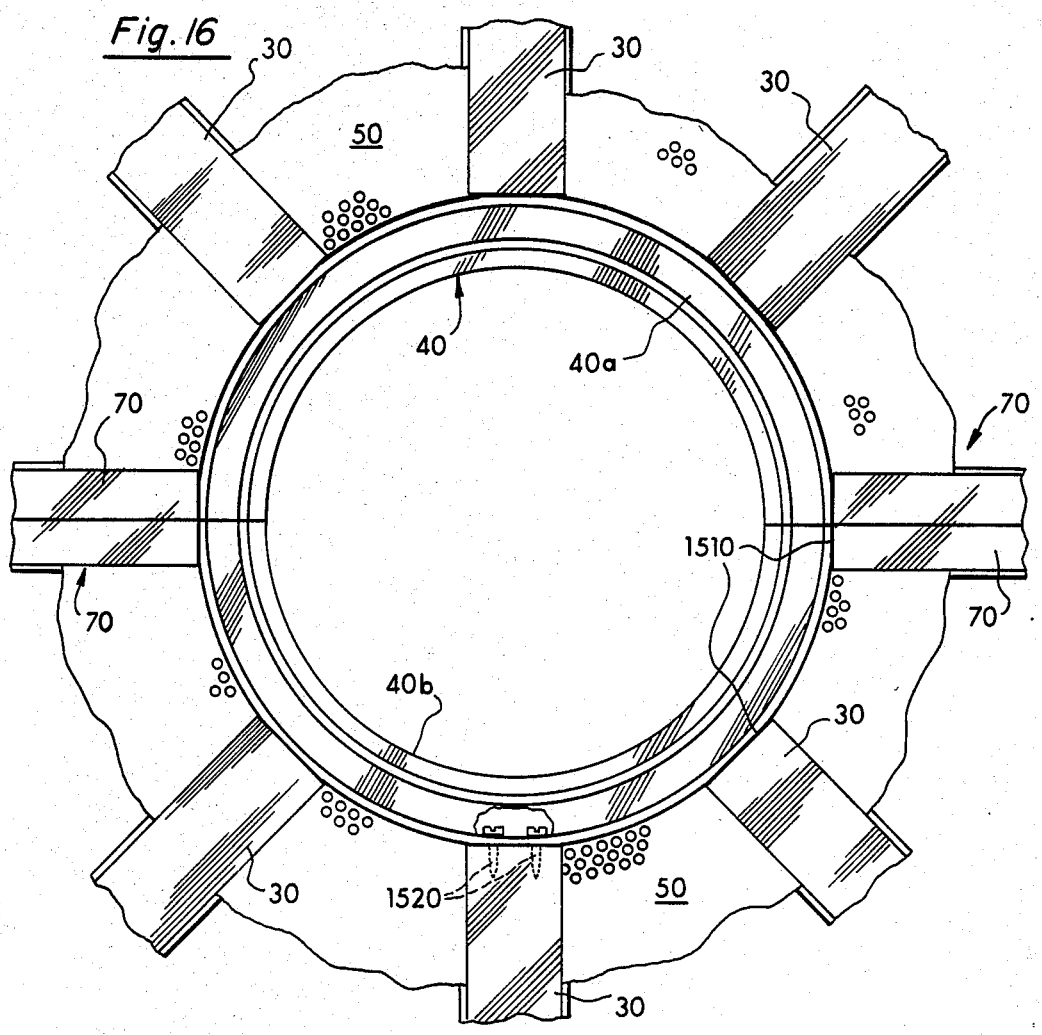
FIG. 16 is a top planar illustration showing the attachment of the rib and split rib support members to the inner ring of the present invention.

As shown in FIG. 16, surface 1510 is a flat surface formed on the circularly shaped ring member 40. In the preferred embodiment, the ring member 40 has two parts, 40(*a*) and 40(*b*) which are held together along the split rim members 70 by means of the bolts of 910 as shown in FIG. 10. It is to be expressly understood that if four splt rib members 70 are utilized to enable the dish antenna of the present invention to be shipped in quadrants, the inner rim 40 would be segmented into four parts.

The upper portion of the inner ring member 40 contains a horizontal cantilevered surface 1540 having a first outer upstanding ridge 1550 and a second lower inner ridge 1560. These ridges 1550 and 1560 are used to mount the sensor 80 as shown in FIG. 1. The upper surface 1552 is flush with surface 200 when the rib is mounted to the inner rim.

3. Installation

Prior to shipment, the rib members are connected by inserting twelve screws 1260 through the outer rim 60 into cavities 214 and 215. Finally the inner rim portions 40(*a*) and 40(*b*) are attached by means of sixteen screws 1520. As mentioned, the dish antenna, in its preferred embodiment, is split into two halves for shipment along the split rib 70. At the site, the antenna is quickly assembled by simply inserting the two splice bars 1200 into cavities 1130 of the outer rim segment 60 and by inserting four screws 1260 into cavities 714 of split rib members 70. Then, the split rim portions 70(*a*) and 70(*b*) are bolted together with a total of eight bolts 910, eight washers 920, and eight nuts 930. The entire dish antenna can be assembled in twenty to thirty minutes.

It is important to note that none of the connection points, just discussed, are disposed in the parabolic reflecting surface and therefore such connection points do not cause any distortion to the signal as they are all located below the reflecting surface.

4. Performance

Testing on a ten foot dish antenna of the present invention of an embodiment having four segments (as opposed to two segments shown in FIG. 1) has a 39.5 db gain with an F/D "Deep Dish" ratio of 0.283. The antenna complies with FCC two-degree spacing requirements with a beamwidth (at −3 dBi test points) of 1.6 degrees.

The screen-mesh is constructed of 0.040 gauge anodized aluminum. The perforation in the screen-mesh eliminates 36 percent of the surface area and is capable of withstanding winds of 125 MPH. The antenna, excluding mounting post, has a total weight of 92 pounds.

While the preferred embodiment has been set forth with a degree of particularity, it is to be understood that changes and modifications could be made to the construction thereof which would still fall within the teachings of the claimed invention as set forth in the following claims.

We claim:

1. A satellite dish antenna comprising:

at least two sections, each of said sections comprising:

(1) a plurality of screen-mesh petals, each of said screen-mesh petals being formed in the shape of a substantial paraboloid having two opposing curved parabolic shaped longitudinal sides and two opposing curved circular shaped ends, each of said sides having a formed downwardly directed arcuate bend extending the entire longitudinal length of said side, (2) a parabolic-shaped support rib firmly engaging the entire longitudinal length of the arcuate bends of adjacent screen-mesh petals for holding said support rib along the entire length of said adjacent petals, each of said support ribs comprising:

(a) an upper rib member having a flat upper surface, a pair of downwardly extending ridges on opposing ends of said upper surface, and two centrally located downwardly extending prongs, said flat upper surface, ridges and prongs extending the entire longitudinal length of said upper rib member, (b) a lower rib member having a vertical support plate, a formed channel centrally located above said support plate, and two outwardly and upwardly extending troughs located on the upper opposing sides of said formed channel, said plate, formed channel, and troughs extending the entire longitudinal length of said upper rib member, and (c) said prongs of said upper rib member being capable of locking into said formed channel of said lower rib member the entire longitudinal length of said support rib to hold said arcuate bends of said adjacent petals between said downwardly extending ridges and said upwardly directed troughs, said upper surface of said upper rib member being in the same plane as said petals, (3) a parabolic-shaped split support rib firmly engaging the entire longitudinal length of the arcuate bend of the screen-mesh petals located on the sides of said sections for holding the aforesaid sides, each of said split support ribs comprising:

(a) an upper split rib member having a flat upper surface cantilevered from a downwardly extending vertical wall, said wall having an inwardly directed lip, and a downwardly extending ridge located beneath the aforesaid upper surface on the end opposing the aforesaid wall, said flat upper surface, vertical wall, and ridge of said upper split rib member extending the entire longitudinal length of said split support rib, (b) a lower split rib member having a downwardly extending vertical wall having a formed channel located midway up said wall and an outwardly and upwardly directed trough located at the top of said wall, and (c) said lip of said upper split rib member being capable of locking into said channel of said lower split rib member the entire longitudinal length of said split support rib to hold the arcuate bend of the screen-mesh petal located on the side of said section between said downwardly extending ridge of said upper split rib member and the upwardly directed trough of the lower split rib member, said upper surface of said upper split rib member being in the same plane as said petals, (4) a circularly curved outer rim member having a formed inwardly directed channel located at the upper end of a vertical wall, said vertical wall having a formed substantially rectangular cavity formed therein, said outer circular end of said petal being capable of seating in said channel the entire length of said outer rim, said outer rim being capable of connecting to the ends of said ribs and split ribs, and (5) a circularly curved inner rim member having a plurality of flat vertical surfaces formed thereon for connecting to the ends of each of said support ribs and said split support ribs; said support ribs, said split support ribs, said outer rim member, and said inner rim member cooperating together to hold said screen-mesh petals in place, means selectively inserting into said formed rectangular cavities of the outer rim members of adjacent sections for holding said adjacent outer rim members together, and means for selectively connecting the split support ribs of adjacent sections together.

2. A satellite dish antenna comprising:

at least two sections, each of said sections comprising:

(1) a plurality of screen-mesh petals, each of said screen-mesh petals being formed in the shape of a substantial paraboloid having two opposing curved parabolic shaped longitudinal sides and two opposing curved circular shaped ends, (2) a parabolic-shaped support rib firmly engaging the entire longitudinal length of said parabolic shaped longitudinal sides of adjacent screen-mesh petals for applying tension forces inwardly directed towards said support rib along the aforesaid longitudinal length of said adjacent petals in the presence of environmental loading forces, each of said support ribs comprising:

(a) an upper rib member having a flat upper reflective surface, a pair of downwardly extending ridges on opposing ends of said upper surface, and two centrally located downwardly extending prongs, said flat upper surface, ridges and prongs extending the entire longitudinal length of said upper rib member, (b) a lower rib member having a vertical support plate, a formed channel centrally located above said support plate, and two outwardly and upwardly extending troughs located on the upper opposing sides of said formed channel, said plate, formed channel, and troughs extending the entire longitudinal length of said upper rib member, and (c) said prongs of said upper rib member being capable of locking into said formed channel of said lower rib member the entire longitudinal length of said support rib to hold said sides of said adjacent petals between said downwardly extending ridges and said upwardly directed troughs, said upper surface of said upper rib member being in the same plane as said screen-mesh, (3) a longitudinal parabolic curved split support rib firmly engaging the entire longitudinal length of the sides of the screen-mesh petals located on the sides of said sections for applying tension forces in the presence of environmental loading forces directed towards said split support rib, each of said split support ribs comprising:

(a) an upper split rib member having a flat upper surface cantilevered from a downwardly extending vertical wall, said wall having an inwardly directed lip, and a downwardly extending ridge located beneath the aforesaid upper surface on the end opposing the aforesaid wall, said flat upper surface, vertical wall, and ridge of said upper split rib member extending the entire longitudinal length of said split support rib, (b) a lower split rib member having a downwardly extending vertical wall having a formed channel located midway up said wall and an outwardly and upwardly directly trough located at the top of said wall, and (c) said lip of said upper split rib member being capable of locking into said channel of said lower split rib member the entire longitudinal length of said split support rib to hold said sides of the screen-mesh petals located on the sides of said sections between said downwardly extending ridges of said upper split rib member and the upwardly directed troughs of the lower split rib member, said upper surface of said upper split rib member being in the same plane as said petals, (4) a circularly curved outer rim member having a formed inwardly directed channel located at the upper end of a vertical wall, said outer circular end of said petal being capable of seating in the aforesaid channel the entire length of said outer rim, said outer rim capable of connecting to the ends of said ribs and support ribs, and (5) a circularly curved inner rim member having a plurality of flat vertical surfaces formed thereon for connecting to the ends of each of said support ribs and said split support ribs, said support ribs, said split support ribs, said outer rim member, and said inner rim member cooperating together to hold said screen-mesh petals in place, means connecting to the ends of said outer rim members of adjacent sections for holding said adjacent outer rim members together, and means for selectively connecting the split support ribs of adjacent sections together.

3. A satellite dish antenna comprising:

at least two sections, each of said sections comprising:

(1) a plurality of reflective petals, each of said petals being formed in the shape of a substantial paraboloid having two opposing curved parabolic shaped longitudinal sides and two opposing curved circular shaped ends, (2) a parabolic-shaped support rib firmly engaging said sides of adjacent petals for holding the aforesaid sides continuously along the aforesaid longitudinal length of said support rib, each of said support ribs comprising:

(a) an upper rib member having a flat upper reflective surface, and (b) a lower rib member for continuously locking into said upper rib member under said reflective surface the entire longitudinal length of said support rib to hold said sides of said adjacent petals between said upper rib member and said lower rib member, said upper reflective surface of said upper rib member being in the said plane as said petals, (3) a longitudinal parabolic curved split support rib firmly engaging the sides of the petals located on the sides of said sections for continuously holding the aforesaid sides along the aforesaid longitudinal length of said split support rib, each of said split support ribs comprising:

(a) an upper split rib member having a flat upper reflective surface, and (b) a lower split rib member for continuously locking into said upper rib member under said reflective surface the entire longitudinal length of said split support rib to hold said sides of the petals located on the sides of said sections between said upper split rib member and the said lower rib member, said upper surface of said upper split rib member being in the same plane as said petals, (4) a circularly curved outer rim member for engaging the outer circular end of said petal the entire length of said outer end, said outer rim member being capable of connecting to said ends of said rib and split rib members, and (5) a circularly curved inner rim member having a plurality of flat vertical surfaces formed thereon for connecting to the ends of each of said support ribs and said split support ribs, said support ribs, said split support ribs, said outer rim member, and said inner rim member cooperating together to hold said petals in place, means connecting to the ends of said outer rim members of adjacent sections for holding said adjacent outer rim members together, and means for selectively connecting the split support ribs of adjacent sections together.

4. A satellite dish antenna comprising:

at least two sections, each of said sections comprising:

(1) a plurality of reflective petals, each of said petals being formed in the shape of a substantial paraboloid having two opposing parabolic shaped longitudinal edges and two opposing circular shaped ends, (2) a parabolic-shaped support rib firmly engaging the edges of adjacent petals for continuously applying tension forces in the presence of environmental loading forces directed inwardly towards the center of said support rib along the entire aforesaid longitudinal length of said adjacent petals, each of said support ribs comprising:

(a) an upper rib member having a flat upper reflective surface, and (b) a lower rib member for locking into said upper rib member under the aforesaid upper reflective surface the entire longitudinal length of said support rib to hold said edges of said adjacent petals between said upper rib member and said lower rib member, said upper reflective surface of said upper rib member being oriented in the same plane as said petals, (3) a parabolic curved split support rib firmly engaging the edges of the petals located on the sides of said sections for continually applying said tension forces in the presence of said environmental forces directed inwardly towards the center of said split support rib, each of said split support ribs comprising:

(a) an upper split rib member having a flat upper reflective surface, and (b) a lower split rib member for locking under said upper rib member the entire longitudinal length of said split support rib to hold said sides of the petals located on the sides of said sections between said upper split rib member and said lower rib member, said upper surface of said upper split rib member being in the same plane as said petals, (4) a circularly curved outer rim member for engaging the outer circular ends of said plurality of petals, said outer rim member being capable of connecting to the ends of said rib and split rib members, and (5) a circularly curved inner ring for connecting to the ends of each of said support ribs and said split support ribs, said support ribs, said split support ribs, said outer rim member, and said inner rim member cooperating together to hold said petals in place, means connecting to the ends of said outer rim members of adjacent sections for holding said adjacent outer rim members together, and means for selectively connecting the split support ribs of adjacent sections together.

5. A satellite dish antenna comprising:

at least two sections, each of said sections comprising:

(1) a plurality of reflective petals, each of said petals being formed in the shape of a substantial paraboloid having two opposing parabolic shaped longitudinal edges and two opposing circular shaped ends, (2) a parabolic-shaped support rib firmly engaging the edges of adjacent petals for continuously holding the aforesaid edges along the entire longitudinal length of said support ribs, said support rib comprising:

(a) an upper rib member having a flat upper reflective surface, and (b) a lower rib member for locking into said upper rib member under the aforesaid upper reflective surface the entire longitudinal length of said support rib to hold said edges of said adjacent petals between said upper rib member and said lower rib member, said upper reflective surface of said upper rib member being oriented in the same plane as said petals, (3) a parabolic curved split support rib firmly engaging the edges of the petals located on the sides of said sections for holding the aforesaid sides along the entire longitudinal length of said split support rib, said split support rib comprising:

(a) an upper split rib member having a flat upper reflective surface, and (b) a lower split rib member for locking under said upper rib member the entire longitudinal length of said split support rib to hold said sides of the petals located on the edges of said sections between said upper split rib member and said lower rib member, said upper surface of said upper split rib member being in the same plane as said petals, (4) a circularly curved outer rim member for engaging the outer circular ends of said plurality of petals, said outer rim member being capable of connecting to the ends of said rib and split rib members, and (5) a circularly curved inner ring for connecting to the ends of each of said support ribs and said split support ribs, means connecting to the ends of said outer rim members of adjacent sections for holding said adjacent outer rim members together, and means for selectively connecting the split support ribs of adjacent sections together.

6. A satellite dish antenna having at least two sections, each of said sections comprising:

a plurality of reflective petals, each of said petals being formed in the shape of a substantial paraboloid having two opposing parabolic shaped longitudinal edges and two opposing circular shaped ends, a parabolic-shaped support rib having a flat upper reflective surface for engaging the edges of adjacent petals, under said flat upper surface, by continuously holding the aforesaid edges along the entire longitudinal length of said support rib, said flat upper reflective surface of said rib being in the same plane as said petals, a parabolic curved split support rib having a flat upper reflective surface for firmly engaging, under said flat upper reflective surface, the edges of the petals located on the sides of said sections for continually holding the aforesaid edges along the entire longitudinal length of said split support rib, said flat upper reflective surface being in the same plane as said petals, a circularly curved outer rim member for engaging the outer circular ends of said plurality of petals, said outer rim member being capable of connecting to the ends of said rib and split rib members, and a circularly curved inner ring for connecting to the ends of each of said support ribs and said split support ribs, means connecting to the ends of said outer rib members of adjacent sections for holding said adjacent outer rib members together, and means for selectively connecting the split support ribs of adjacent sections together.

7. The satellite dish antenna of claim 6 wherein said support rib comprises:

an upper rib member having said flat upper reflective surface, and a lower rib member for locking into said upper rib member the substantial longitudinal length of said support rib to hold said edges of said adjacent petals between said upper rib member and said lower rib member.

8. The satellite dish antenna of claim 6 wherein said split support rib comprises:

an upper split rib member having said flat upper reflective surface, and a lower split rib member for locking under said upper rib member the substantial longitudinal length of said split support rib to hold said sides of the petals located on the sides of said sections between said upper split rib member and said lower rib member.

9. In a satellite dish antenna, having a plurality of reflective petals, an apparatus for connecting adjacent petals together, said apparatus comprising:

each of said petals being formed in the shape of a substantial paraboloid having two opposing parabolic shaped longitudinal edges and two opposing circular shaped ends, a parabolic-shaped support rib firmly engaging the edges of adjacent petals for continuously applying tension forces only in the presence of environmental loading forces directed inwardly towards the center of said support rib along the entire aforesaid longitudinal length of said adjacent petals, said support rib comprising:

(a) an upper rib member having a flat upper reflective surface, and (b) a lower rib member for locking into said upper rib member under the aforesaid upper reflective surface the entire longitudinal length of said support rib to hold said edges of said adjacent petals between said upper rib member and said lower rib member, said upper reflective surface of said upper rib member being oriented in the said plane as said petals, and a parabolic curved split support rib firmly engaging the edges of the petals located on the sides of said sections for continually applying said tension forces only in the presence of said environmental forces directed inwardly towards the center of said split support rib, each of said split support ribs comprising:

(a) an upper split rib member having a flat upper reflective surface, and (b) a lower split rib member for locking under said upper rib member the substantial longitudinal length of said split support rib to hold said sides of the petals located on the sides of said sections between said upper split rib member and said lower rib member, said upper surface of said upper split rib member being in the same plane as said petals.

10. In a satellite dish antenna comprising at least two sections, each of said sections containing a plurality of reflective petals interconnected together, an apparatus for connecting the two sections together, said apparatus comprising:

a parabolic curved split support rib firmly engaging the edges of the petals located on the sides of said sections for continually holding the aforesaid edges along the entire longitudinal length of said split support rib, said split support rib comprising:

(a) an upper split rib member having a flat upper reflective surface, and (b) a lower split rib member for locking under said upper rib member the substantial longitudinal length of said split support rib to hold said sides of the petals located on the sides of the said sections between said upper split rib member and said lower rib member, said upper surface of said upper split rib member being in the same plane as said petals, and means for selectively connecting the split support ribs of the adjacent sections together.

11. In a satellite dish antenna having a plurality of adjacent reflective petals, an apparatus for connecting adjacent petals together, said apparatus comprising:

each of said petals being formed in the shape of a substantial paraboloid having two opposing curved parabolic shaped longitudinal sides and two opposing curved circular shaped ends, each of said sides having a formed downwardly directed arcuate bend extending the entire longitudinal length of said side, and a parabolic-shaped support rib for firmly engaging the entire longitudinal length of the arcuate bends of adjacent petals, said support rib comprising:

(a) an upper rib member having a flat upper surface, a pair of downwardly extending ridges on opposing ends of said upper surface, and two centrally located downwardly extending prongs, said flat upper surface, ridges and prongs extending the substantial longitudinal length of said upper rib member, (b) a lower rib member having a vertical support plate, a formed channel centrally located above said support plate, and two outwardly and upwardly extending troughs located on the upper opposing sides of said formed channel, said plate, formed channel, and troughs extending the substantial longitudinal length of said upper rib member, and (c) said prongs of said upper rib member being capable of locking into said formed channel of said lower rib member the substantial longitudinal length of said support rib to hold said arcuate bends of said adjacent petals between said downwardly extending ridges and said upwardly directed troughs, said upper surface of said upper rib member being in the same plane as said petals.

12. In a satellite dish antenna having a plurality of adjacent reflective petals, an apparatus for connecting adjacent petals together, said apparatus comprising:

each of said petals being formed in the shape of a substantial paraboloid having two opposing curved parabolic shaped longitudinal sides and two opposing curved circular shaped ends, and a parabolic-shaped support rib firmly engaging the entire longitudinal length of said parabolic shaped longitudinal sides of adjacent petals for holding the aforesaid sides to said support rib, said support rib comprising:

(a) an upper rib member having a flat upper reflective surface, a pair of downwardly extending ridges on opposing ends of said upper surface, and two centrally located downwardly extending prongs, said flat upper surface, ridges and prongs extending the substantial longitudinal length of said upper rib member, (b) a lower rib member having a vertical support plate, a formed channel centrally located above said support plate, and two outwardly and upwardly extending troughs located on the upper opposing sides of said formed channel, said plate, formed channel, and troughs extending the substantial longitudinal length of said upper rib member, and (c) said prongs of said upper rib member being capable of locking into said formed channel of said lower rib member the substantial longitudinal length of said support rib to hold said sides of said adjacent petals between said downwardly extending ridges and said upwardly directed troughs, said upper surface of said upper rib member being in the same plane as said petals.

13. In a satellite dish antenna comprising at least two sections with each of said sections having a plurality of reflective petals each petal having parabolic-shaped arcuate bends, and an apparatus for holding the two sections together, said apparatus comprising:

a parabolic-shaped split support rib firmly engaging the substantial longitudinal length of said arcuate bends located on the sides of said sections for holding the aforesaid bends to said split support rib, said split support rib comprising:

(a) an upper split rib member having a flat upper surface cantilevered from a downwardly extending vertical wall, said wall having an inwardly directed lip, and a downwardly extending ridge located beneath the aforesaid upper surface on the end opposing the aforesaid wall, said flat upper surface, vertical wall, and ridge of said upper split rib member extending the entire longitudinal length of said split support rib, (b) a lower split rib member having a downwardly extending vertical wall having a formed channel located midway up said wall and an outwardly and upwardly directly trough located at the top of said wall, and (c) said lip of said upper split rib member being capable of locking into said channel of said lower split rib member the substantial longitudinal length of said split support rib to hold the arcuate bend of the petal located on the side of said section between said downwardly extending ridge of said upper split rib member and the upwardly directed trough of the lower split rib member, said upper surface of said upper split rib member being in the same plane as said petal, and means for selectively connecting the split support ribs of adjacent sections together.

14. In a satellite dish antenna comprising at least two sections with each of said sections having a plurality of reflective petals and an apparatus for holding the two sections together, said apparatus comprising:

a longitudinal parabolic curved split support rib for firmly engaging the substantial longitudinal length of the edges of the petals, said split support rib comprising:

(a) an upper split rib member having a flat upper surface cantilevered from a downwardly extending vertical wall, said wall having an inwardly directed lip, and a downwardly extending ridge located beneath the aforesaid upper surface on the end opposing the aforesaid wall, said first upper surface, vertical wall, and ridge of said upper split rib member extending the substantial longitudinal length of said split support rib, (b) a lower split rib member having a downwardly extending vertical wall having a formed channel located midway up said wall and an outwardly and upwardly directly trough located at the top of said wall, and (c) said lip of said upper split rib member being capable of locking into said channel of said lower split rib member the substantial longitudinal length of said split support rib to hold said sides of the petals located on the sides of said sections between said downwardly extending ridges of said upper split rib member and the upwardly directed troughs of the lower split rib member, said upper surface of said upper split rib member being in the same plane as said petals, and means for selectively connecting the split support ribs of the adjacent sections together.

15. In a satellite dish antenna comprising at least two sections with each of said sections having a plurality of reflective petals and an apparatus for holding the two sections together, said apparatus comprising:

a longitudinal parabolic curved split support rib for firmly engaging the sides of the petals located on the sides of said sections, said split support rib comprising:

(a) an upper split rib member having a flat upper reflective surface, and (b) a lower split rib member for locking into said upper rib member under said reflective surface the substantial longitudinal length of said split support rib to hold said sides of the reflective petals located on the sides of said sections between said upper split rib member and the said lower rib member, said upper surface of said upper split rib member being in the same plane as said petals, and means for selectively connecting the split support ribs of adjacent sections together.

* * * * *